US005700135A

United States Patent [19]

Inokuchi et al.

[11] Patent Number: 5,700,135

[45] Date of Patent: Dec. 23, 1997

[54] BELLOWS CAM PLATE PUMP

[75] Inventors: Iwane Inokuchi; Shigeru Kamegaya; Toshikazu Oshidari; Atsuhiro Sakamoto, all of Yokohama, Japan

[73] Assignee: Nissan Motor Co., LTD., Kanagawa, Japan

[21] Appl. No.: 598,580

[22] Filed: Feb. 12, 1996

[30] Foreign Application Priority Data

Feb. 24, 1995 [JP] Japan ..... 7-037201

[51] Int. Cl.[6] ..... F04B 43/00

[52] U.S. Cl. ..... 417/269; 417/473; 92/71; 92/36

[58] Field of Search ..... 417/269, 473; 92/71, 36, 37

[56] References Cited

U.S. PATENT DOCUMENTS

| | | | |
|---|---|---|---|
| 1,715,735 | 6/1929 | Banning, Jr. | 417/473 |
| 2,392,279 | 1/1946 | Woods | 92/71 |
| 2,889,781 | 6/1959 | Thompson | 92/71 |
| 4,010,621 | 3/1977 | Raetz | 60/516 |
| 4,723,894 | 2/1988 | Marx | 417/269 |
| 4,801,249 | 1/1989 | Kakizawa | 417/269 |
| 4,902,206 | 2/1990 | Nakazawa et al. | 92/37 |

FOREIGN PATENT DOCUMENTS

| | | |
|---|---|---|
| 2-7385 | 1/1990 | Japan . |
| 4-191461 | 7/1992 | Japan . |

*Primary Examiner*—Timothy Thorpe
*Assistant Examiner*—Ted Kim
*Attorney, Agent, or Firm*—Lowe, Price, LeBlanc & Becker

[57] ABSTRACT

A cam plate pump comprises a pressurizing chamber formed by a bellows which elongates and contracts along a center axis parallel to the input shaft of the pump. The cam plate rotates together with the input shaft, and compresses the bellows via a piston. A mechanism for guiding the piston along the center axis, and a mechanism for blocking the rotational torque acting on the bellows via the piston are provided. These mechanisms prevent a bending load or twisting load from acting on the bellows.

12 Claims, 8 Drawing Sheets

BELLOWS CAM PLATE PUMP

FIELD OF THE INVENTION

This invention relates to a bellows cam plate pump used for example as a fuel injection pump in an automobile engine.

BACKGROUND OF THE INVENTION

In an automobile engine fuel injection pump, it is advantageous to maintain a high fuel pressure to assist conversion of injected fuel to fine droplets or prevent vapor from being generated in the passages.

One type of pump suitable for obtaining high pressure is a plunger pump. The pump has a plunger which slides inside a cylinder so as to pressurize fluid in the cylinder, however if fuel of relatively low viscosity, e.g., gasoline, is pressurized, fuel tends to leak from the slide gap between the cylinder and the plunger, and due to this loss, the drive torque of the pump increases.

In this context, Tokkai Hei 4-191461 published by the Japanese Patent Office in 1992 discloses a pump having pressurizing chambers sealed by bellows that elongates and contract for pressurizing fluids.

The bellows are disposed in parallel with each other, fuel being aspirated into the pressurizing chambers and pressurized by the elongation and contraction of the bellows due to the action of cams provided on a cam shaft which rotates in synchronism with the engine.

In this pump, as a plurality of pressurizing chambers are disposed in parallel in a straight line, the size of the pump is large. Also, in a multi-cylinder engine, as the fuel injection period Is different for each cylinder, It is necessary to always maintain the discharge pressure of the fuel injection pump constant, and therefore necessary to have each bellows elongating and contracting at equal angular intervals. This may be achieved by setting the cams to have different phases, however this makes the form of the cam shaft too complex.

Jikkai Hei 2-7385 published by the Japanese Patent Office in 1990 discloses a diaphragm cam plate pump. In this pump, diaphragms forming pressurizing chambers are disposed on a circle, the center axes of the chambers being parallel. By disposing the chambers in this fashion, the pump is smaller and the cams are replaced by a cam plate. In the prior art, diaphragms were used to form pressurizing chambers, however if these diaphragms are replaced by bellows, it is possible to make the elongation/contraction stroke in the chamber larger and its diameter smaller, and therefore to make the pump more compact.

In such a cam plate pump, however, the bellows tend to be damaged by a load in bending or turning direction exerted by the earn plates on the bellows, so the pump tended to have poor durability. Since the bending and turning loads are larger as the pump pressure increases, It is difficult to obtain high fuel pressure in such a bellows type cam plate pump.

The aforesaid bellows type pump disclosed in Tokkai Hei 4-191461, the bellows fit on the inside of an envelope-shaped guide so that the bellows deform along the guide. However, if the ends of the bellows are fixed by welding, it is difficult to form the bellows and guide perfectly coaxially due to errors in welding, and if such errors exist, a bending load acts on the bellows when the bellows are fitted on the guide. In particular if the thickness of parts comprising the bellows is increased so as to increase durability, this bending load increases due to increased rigidity of the bellows and it becomes difficult to assemble the pump.

SUMMARY OF THE INVENTION

It is therefore an object of this invention to reduce the bending and turning loads acting on the bellows in a bellows type cam plate pump.

It is another object of this invention to provide a bellows type pump having a structure which absorbs errors when the bellows are fixed.

In order to achieve the above objects, this invention provides a bellows cam plate pump comprising an input shaft, a pressurizing chamber formed by a bellows that elongates and contracts along a center axis parallel to the input shaft, a cam plate fixed at an inclination to the input shaft, an inlet port for supplying fluid to the pressurizing chamber according to an expansion of the chamber, an outlet port for discharging fluid from the pressurizing chamber according to a contraction of the chamber, a mechanism for compressing the bellows by a displacement according to a rotation of the cam plate, a mechanism for guiding the displacement of the compressing mechanism along the center axis of the bellows, and a mechanism for blocking a rotational torque acting on the bellows via the compressing mechanism.

According to an aspect of this invention, the compressing mechanism comprises a bearing mechanism comprising a plate, a member which rolls between the cam plate and the plate such that the cam plate is free to rotate relative to the plate, and a piston which comes in contact with the plate.

The guiding mechanism preferably comprises a cylinder for guiding the piston such that the piston is free to slide along the center axis.

The blocking mechanism preferably comprises a mechanism for stopping a rotation of the plate.

The piston preferably comprises a depression for accommodating one end of the bellows. The depression is preferably formed with such dimensions that the depression accommodates the end of the bellows with a clearance. The depression preferably has a plane at right angles to the center axis, and the bellows comes in contact with the piston in the plane.

According to another aspect of this invention, the compressing mechanism comprises a piston which comes in contact with the cam plate.

The guiding mechanism preferably comprises a cylinder for guiding the piston such that the piston is free to slide along the center axis.

The piston preferably comprises a depression for accommodating one end of the bellows.

The depression preferably has a plane at right angles to the center axis, and the blocking mechanism comprises a member connected to the bellows, the member having a spherical surface which comes in contact with the plane. Alternatively, the blocking mechanism may comprise a member connected to the bellows, this member having a projection which comes in contact with the plane. The depression is preferably formed with such dimensions that the depression accommodates one end of the bellows with a clearance.

The details as well as other features and advantages of this invention are set forth in the remainder of the specification and are shown in the accompanying drawings.

DESCRIPTION OF THE PREFERRED EMBODIMENTS

Figure 1:
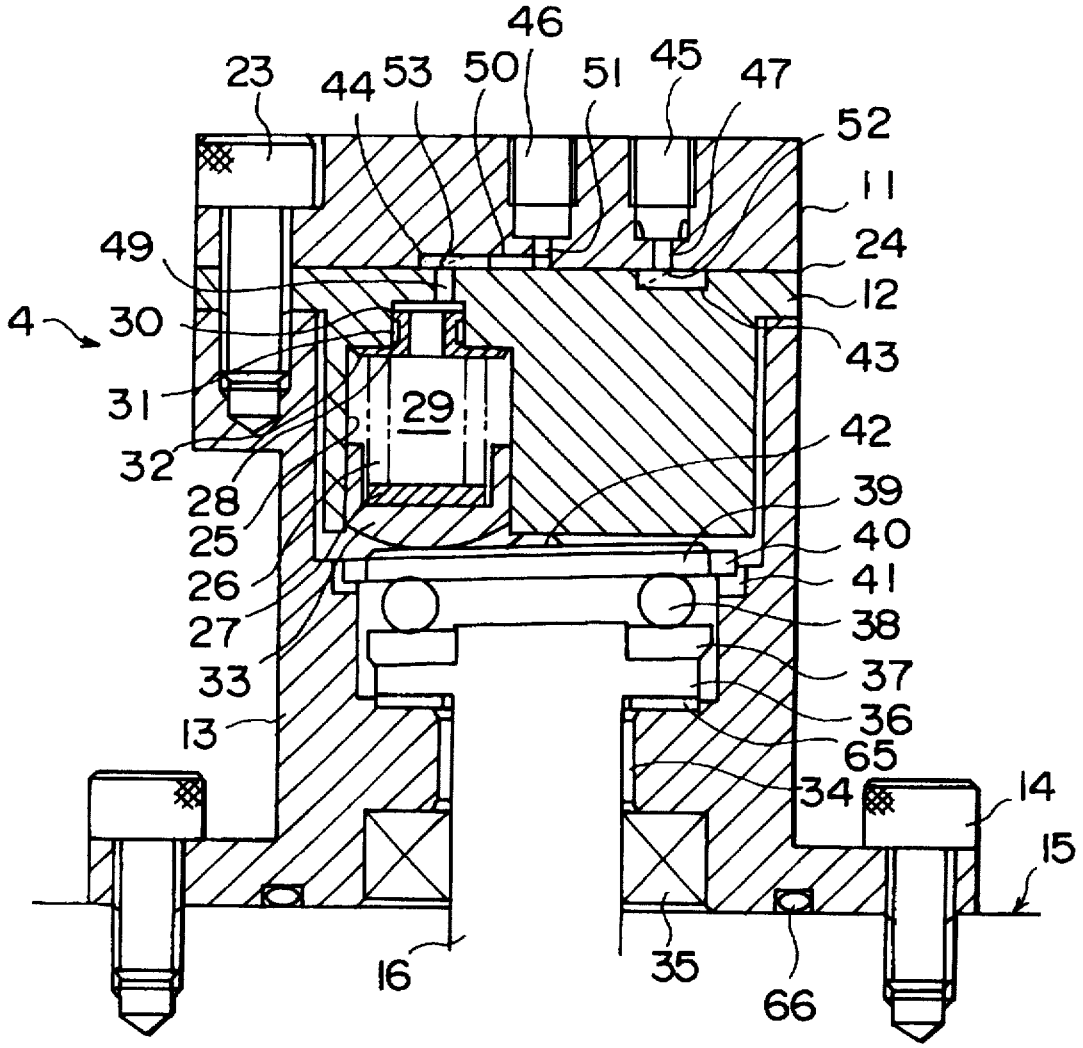
FIG. 1 is a vertical sectional view of a fuel injection pump according to this invention.

Referring to FIG. 1 of the drawings, in a fuel injection pump 4, bellows 26 elongate and contract via a plate 39 due to the rotation of an input shaft 16, fuel is aspirated from an inlet port 45 to a pressurizing chamber 29 inside the bellows 26, the fuel is pressurized, and is then discharged from an outlet port 46.

Figure 7:
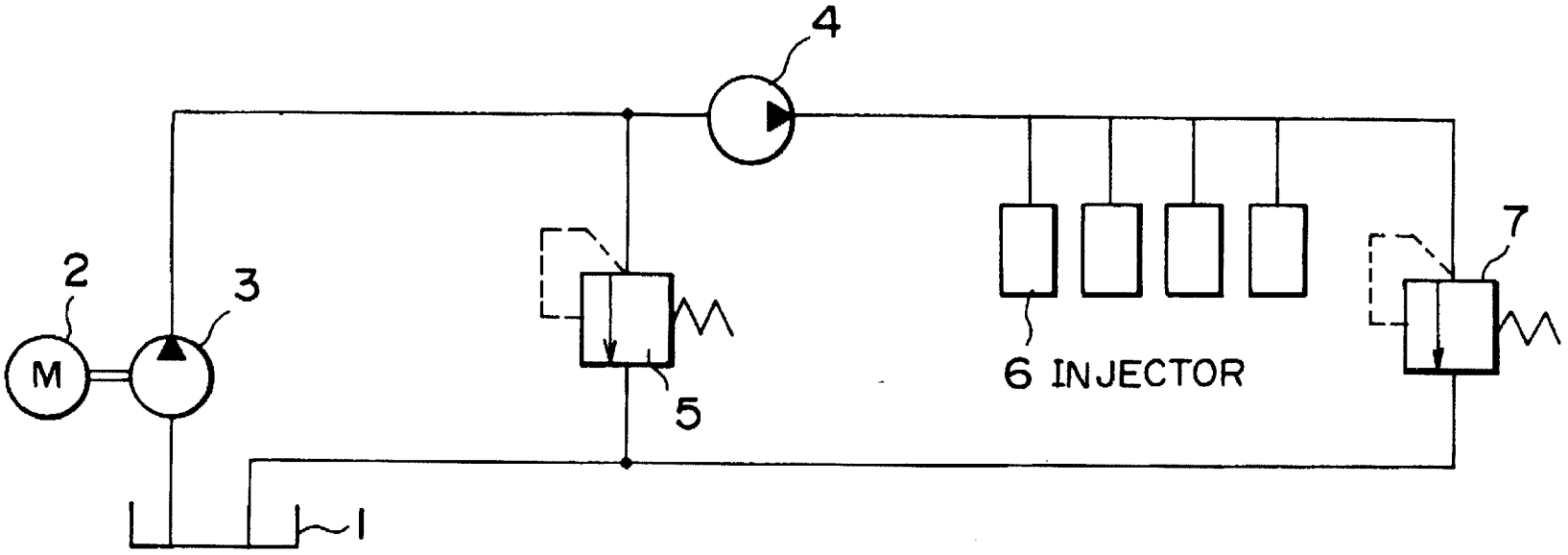
FIG. 7 is a schematic diagram of a fuel injection system according to this invention.

The fuel injection pump 4 is applied to an automobile engine fuel injection system shown in FIG. 7. In this system, a feed pump 3 driven by an electric motor 2 supplies fuel from a tank 1 to the inlet port 45 of the fuel injection pump 4. This supply pressure is maintained effectively constant by a low pressure regulator 5. The fuel injection pump 4 sends pressurized fuel from the outlet port 46 to injectors 6 through high pressure piping. The discharge pressure of the fuel injection pump 4 is maintained effectively constant by a high pressure regulator 7.

Figure 8:
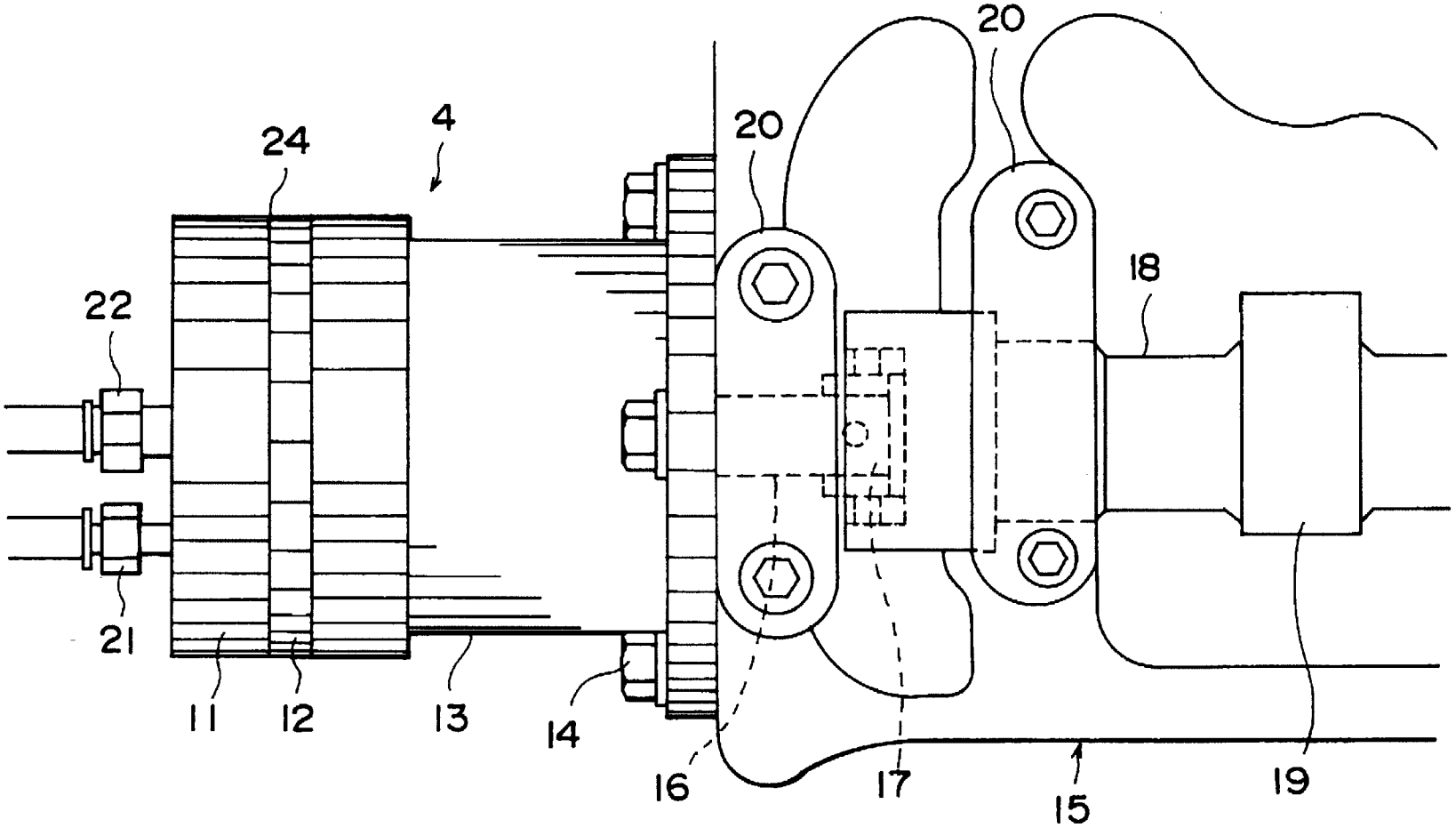
FIG. 8 is a plan view of the fuel injection pump and a part of a cylinder head according to this invention.

The fuel injection pump 4 comprises a pump head 11, cylinder block 12 and casing 13. As shown in FIG. 8, the casing 13 is fixed to an engine cylinder head 15 by bolts 14. An O-ring 66 is fitted in the join surface of the casing 13 and cylinder head 15.

An input shaft 16 of the pump 4 Is connected to an air intake cam shaft 18 via a connector 17 which elongates and contracts in an axial direction. The intake cam shaft 18 is supported on the cylinder head 15 via a bracket 20. The cam shaft 18 rotates in synchronism with the engine so as to open and close an intake valve, not shown, by a cam 19, and it also rotates the input shaft 16.

Connectors 21, 22 are attached to the pump head 11 of the pump 4, these connectors connecting piping to the inlet port 45 and outlet port 46.

Figure 6:
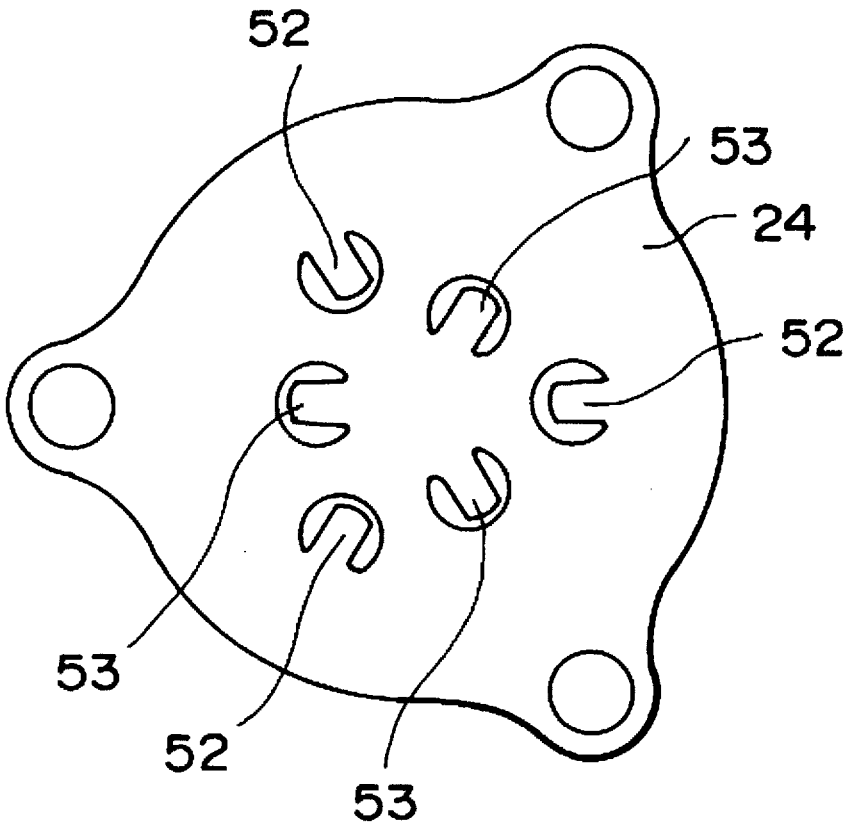
FIG. 6 is a plan view of reed valves according to this invention.

The pump head 11, cylinder block 12 and casing 13 are joined together by bolts 23 as shown in FIG. 1. A reed plate 24 comprising three inlet reed valves 52 and three outlet reed valves 53, as shown in FIG. 6, is gripped between the pump head 11 and cylinder block 12.

Three cylinders 25 are formed in the pump housing 12 around its central axis, each of the cylinders 25 opening towards the end face of the housing 12 adjacent to the casing 13. These bellows 26 each having a cylindrical shape are respectively fitted on the inside of the cylinders 25.

An end plate 27 is welded to one end, corresponding to the lower end in FIG. 1, of the bellows 26. This end also fits inside a cylindrical cap-shaped piston 33. By forming the piston 33 in this shape, the axial length of the pump is made shorter.

A flange 28 is welded to the opposite end, i.e. the upper end in FIG. 1, of the bellows 26. The pressurizing chamber 29 is therefore formed by the bellows 26, end plate 27 and flange 28.

The flange 28 comprises a boss 30. The boss 30 fits in a hollow formed in the base, corresponding to the upper end in FIG. 1, of the cylinder 25. An O-ring 31 is fitted on the outer circumference of the boss 30 to prevent fuel leaks from the pressurizing chamber 29.

The outer diameter of the boss 30 is made smaller than the effective diameter of the bellows 26. The pressure of the pump chamber 29 acts on the flange 28 both upward and downward in FIG. 1, and by making the outer diameter of the boss 30 less than the effective diameter of the bellows 26, the area which receives the upward pressure is larger than the area which receives the downward pressure. The pressure of the pressurizing chamber 29 therefore acts in an upward direction on the flange 28. Due to this pressure and the elastic elongating force of the bellows 26 itself, the flange 28 is held at the upper end of the cylinder 25. Also, as the feed pump 3 is constantly operating when the engine Is running, a pressure higher than a certain level is always acting in the pressurizing chamber 29.

The outer diameter of the flange 28 is set to be larger than the outer diameter of the bellows 26 so that a protrusion 32 of the flange 28 is formed outside the bellows 26. When the pump Is assembled, a ring-shaped jig having an inner diameter larger than the outer diameter of the bellows 26 is pressed against this protrusion 32, so that the bellows 26 is placed in the right position in the cylinder 25 without applying a large force to the bellows 26.

The piston 33 fits inside the cylinder 25, the outer circumference of the base facing downwards in FIG. 1 being spherical.

The end plate 27 comes in contact with this base inside the piston 33. A small clearance is set between the outer circumference of the base plate 27 and the inner circumference of the base of the piston 33. Errors arising in the machining or assembly of the bellows 26, such as positional errors when the end plate 27 and flange 28 are welded to the bellows 26, are absorbed by this clearance. This clearance also makes It easier to assemble the bellows 26 and piston 33.

The casing 13 supports the input shaft 16 at its center via a bushing 34. The casing 13 is also provided with an oil seal 35 which is in contact with the input shaft 16.

An abutment 36 protruding inside the casing 13 is formed at the tip of the input shaft 16. The thickness of the abutment 36 is different depending on the position, its lower surface forming a right angle with the input shaft 16, and it is supported inside the casing 13 by thrust washers 65. The upper surface on the other hand is inclined.

A thrust bearing comprising a plate 37, balls 38 and a plate 39 is supported on the inclined surface. The plate 37 is annular, fixed to the abutment 36 and rotates together with the input shaft 16. The plate 39 is circular, a hemispherical projection 42 formed at its center coming in contact with the cylinder block 12. The spherical lower bases of the three pistons 33 come in contact with this plate 39. The balls 38 are gripped between the plates 37 and 39.

Projections 40 which project radially are formed at two locations on the cuter circumference of the plate 39. These projections 40 engage with a groove 41 formed in the casing 13 so as to prevent rotation of the plate 39. When the inclined plate 37 rotates, therefore, the ball 38 rolls on the plate 37, and the outer circumference of the plate 39 having the projection 42 at its center is displaced in an axial direction without rotating. This projection 42 is also useful in preventing the plate 39 from overcompressing the bellows 26 when the pump is assembled. In this pump, the abutment 36 is the cam plate.

Figure 4:
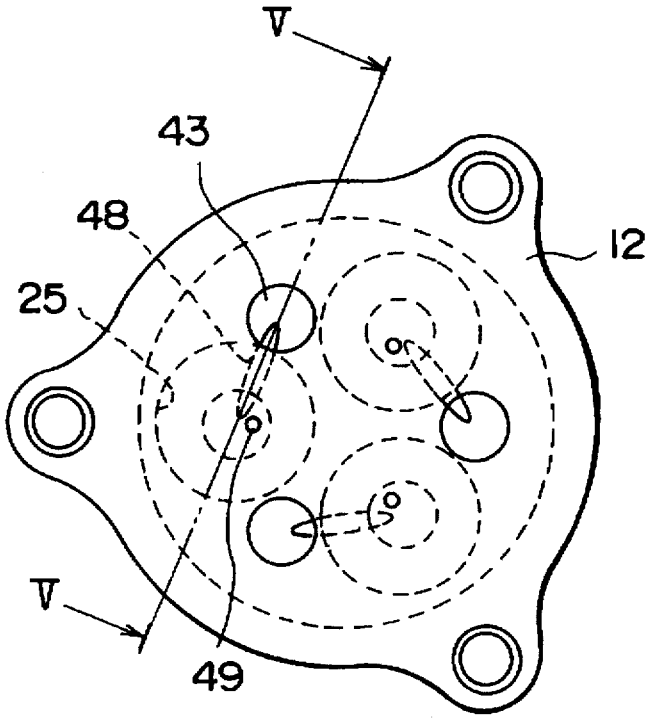
FIG. 4 is a plan view of a pump housing according to this invention.
Figure 5:
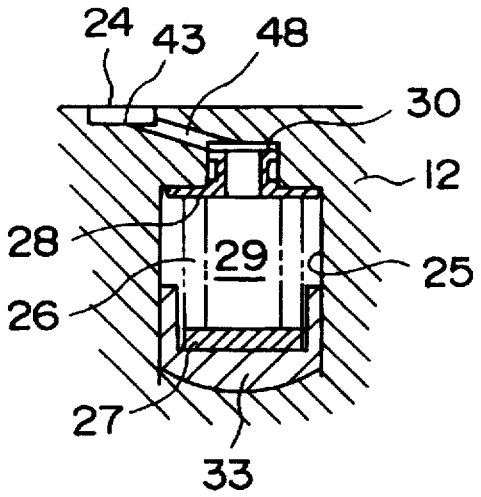
FIG. 5 is a sectional view of a part of the fuel injection pump taken along a the V—V in FIG. 4.

Depressions 43 for operating the three intake reed valves 52 shown in FIG. 6 are formed at three locations on the Join surface between the cylinder block 12 and pump head 11 such that they are situated in positions between the three cylinders 25 as shown in FIG. 4. These depressions 43 are connected to the pressurizing chambers 29 via an oil passage 48 formed in the cylinder block 12 and a space inside the boss 30 of the flange 28.

Figure 2:
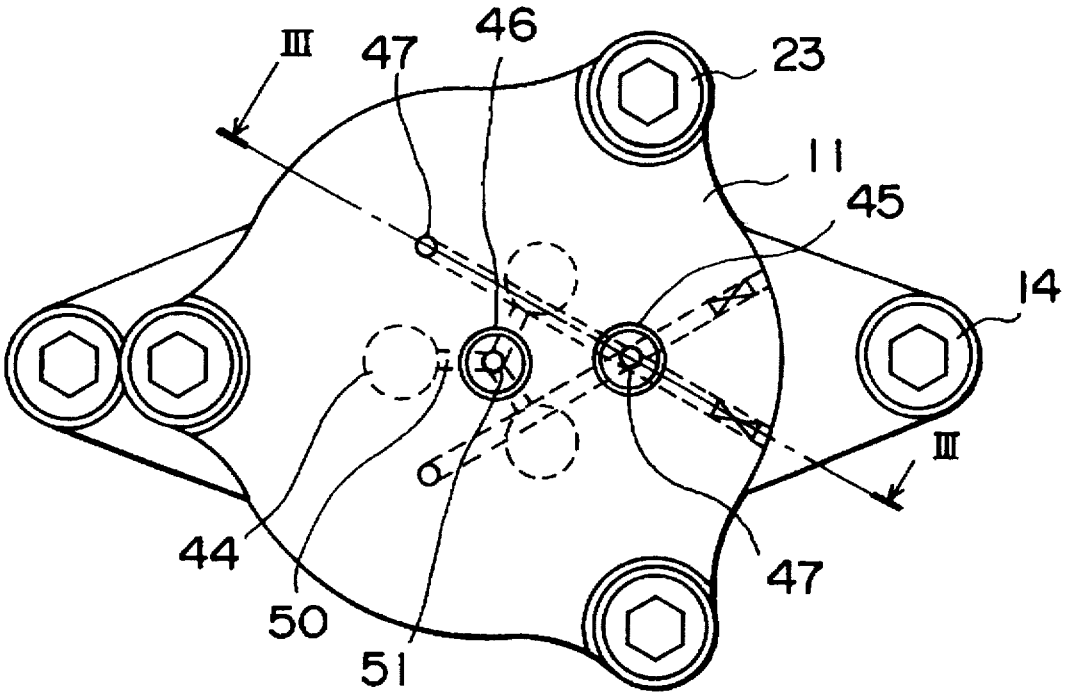
FIG. 2 is a plan view of the fuel injection pump according to this invention.
Figure 3:
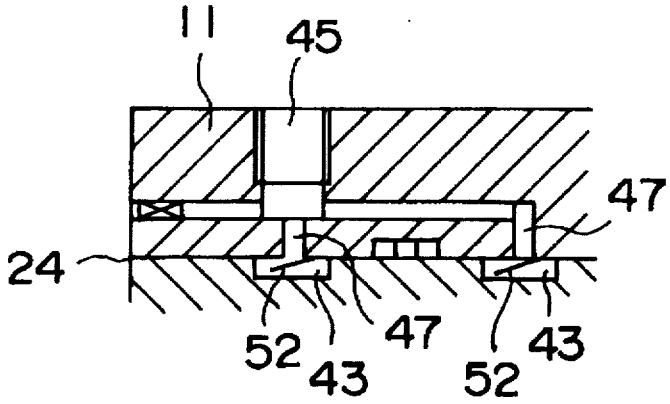
FIG. 3 is a sectional view of a part of the fuel injection pump taken along a line III—III in FIG. 2.

Oil passages 47 connecting the intake ports 45 to the three depressions 43 are formed in the pump head 11 as shown in FIG. 2. These oil passages 47 respectively open onto the depressions 43 of the cylinder block 12 as shown in FIG. 3. The intake reed valves 52 open when the pressurizing chambers 29 are at lower pressure, and close when they are at higher pressure, than the intake ports 45.

Depressions 44 for operating the three intake reed valves 52 are formed at three positions on the join surface between the pump head 11 and cylinder block 12. These depressions 44 are connected to the outlet ports 46 via grooves 50 formed on the join surface of the pump head 11 and oil passages 51 formed inside the pump head 11.

Three oil passages 49 connected via a space inside the boss 30 to the pressurizing chambers 29 are formed in the cylinder head 12, as shown in FIG. 1. These oil passages 49 respectively open onto the depressions 44. The outlet reed valves 53 open when the pressurizing chambers 29 are at higher pressure, and close when they are at lower pressure, than the outlet ports 46.

Both the intake reed valves 52 and outlet reed valves 53 are formed by providing a hoof-shaped notch in a reed plate 24. The intake reed valves 52 and outlet reed valves 53 are disposed alternately as shown in FIG. 6 in order to limit increase of diameter of the fuel injection pump 4.

The inside of the casing 13 is filled with a lubricating off so as to reduce sliding friction and wear of sliding parts.

When the input shaft 16 rotates in synchronism with the engine, the plate 37 fixed to the input shaft 16 in an inclined orientation, rotates. However, the plate 39 is prevented from rotating by the projections 40, so the balls 38 roll between the plates 37 and 39 which brings relative rotation of the plates. The plate 37, which rotates in an inclined orientation, causes the plate 39 to pivot about a contact point of the projection 42 and the cylinder block 12 such that its outer circumference is displaced in an axial direction. Accordingly the piston 33 whereof the tip comes in contact with the plate 39 is driven in an axial direction so that the bellows 26 elongate or contract.

When the plate 39 is displaced away from the piston 33, the volume of the pressurizing chamber 29 increases due to the elastic elongating force of the bellows 26, and the pressure in the chamber 29 falls. Fuel therefore flows into the chamber from the intake port 45 via the oil passage 47, intake reed valve 52 and oil passage 48. The outlet reed valve 53 is closed at this time.

When the plate 39 pushes the piston 33 into the cylinder 25, the bellows 26 are compressed and the pressure in the pressurizing chamber 29 rises. Fuel in the chamber 29 is therefore discharged from the outlet port 46 via the outlet reed valve 53, groove 50 and oil passage 51.

Herein, as the plate 39 is tilted when the plate 39 pushes the end of the bellows 26 via the piston 33, the contact point between the plate 39 and piston 33 is displaced from the center of the piston. When the plate 39 rotates, therefore, a rotational torque acts on the piston 33 which also acts on the bellows 26 as a twisting force. According to this invention, however, due to the structure of the thrust bearing comprising the plate 37, balls 38 and plate 39, almost no rotational torque acts on the plate 39.

Even if a rotational torque does act on the plate 39, rotation of the plate 39 is prevented by the projections 40, so a rotational torque is not transmitted to the piston 33. Hence, no large twisting force acts on the bellows 26, and there is almost no wear between the plate 39 and piston 33.

Instead of the projections 40, a hollow corresponding to the spherical surface of the base of the piston 33 may be provided in the contact part between the plate 39 and piston 33.

If the sole objective were to prevent a twisting force from acting on the bellows, It would be sufficient to provide a stop between the piston 33 and cylinder 25, however in this case slipping between the plate 39 and the base of the piston 33 cannot be prevented.

As the plate 39 is inclined, in addition to a force parallel to the center axis of the cylinder 25, a force perpendicular to the center axis also acts on the piston 33. This perpendicular force however is supported in the sliding parts of the piston 33 and cylinder 25, so a bending load does not act on the bellows 26.

Figure 9:
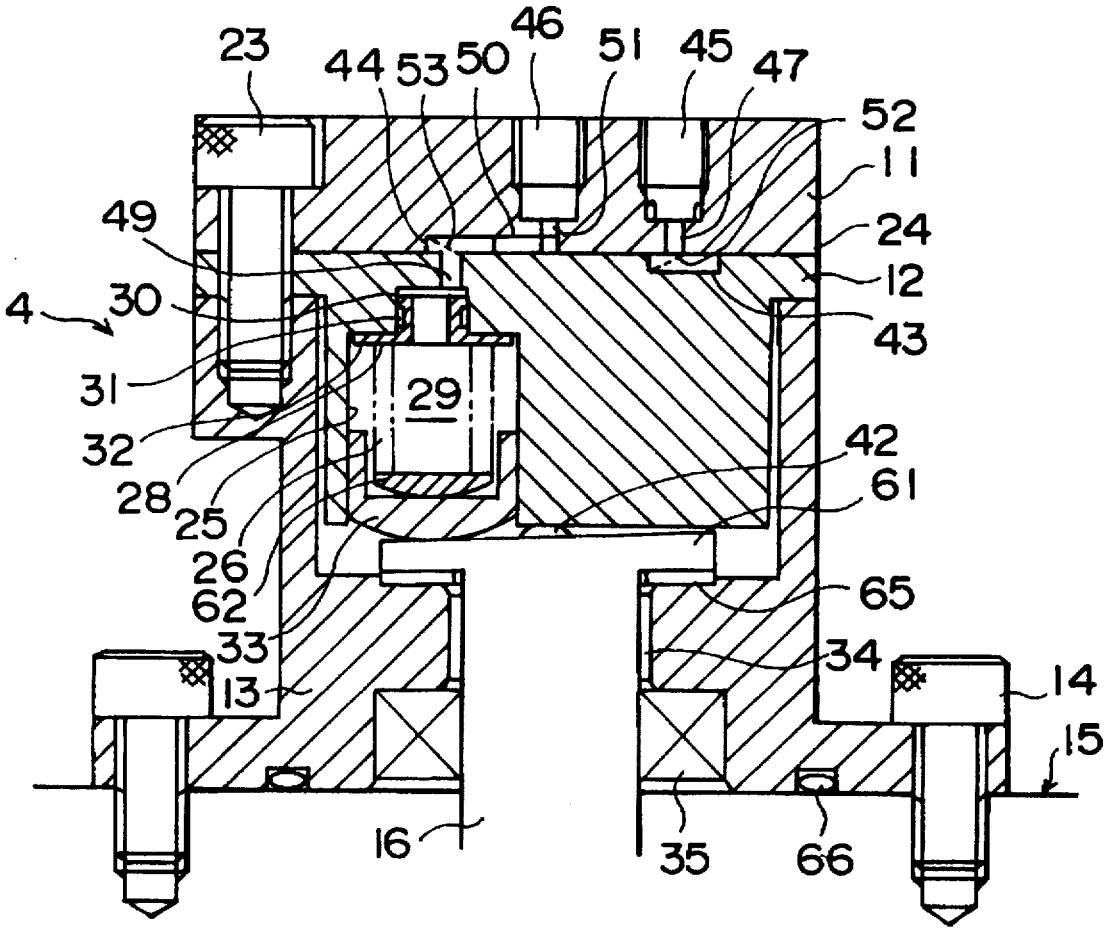
FIG. 9 is a vertical sectional view of a fuel injection pump according to a second embodiment of this invention.

FIG. 9 shows a second embodiment of this invention.

According to this embodiment, a cam plate 61 is formed at the tip of the input shaft 16, the piston 33 corning in contact with this cam plate 61. Also, instead of the flat end plate 27, an end plate 62 whereof the contact surface with the piston 33 is spherical, is fixed to the bellows 26.

As the contact point of the cam plate 61 and piston 33 is displaced from the center of the piston 33, a rotational torque acts on the piston 33 depending on the rotation of the cam plate 61. However, as the end plate 62 and piston 33 have a contact point at the center of the piston 33, almost no rotational torque is transmitted to the end plate 62 even if the piston 33 rotates, and a large twisting force does not act on the bellows 26.

Figure 10:
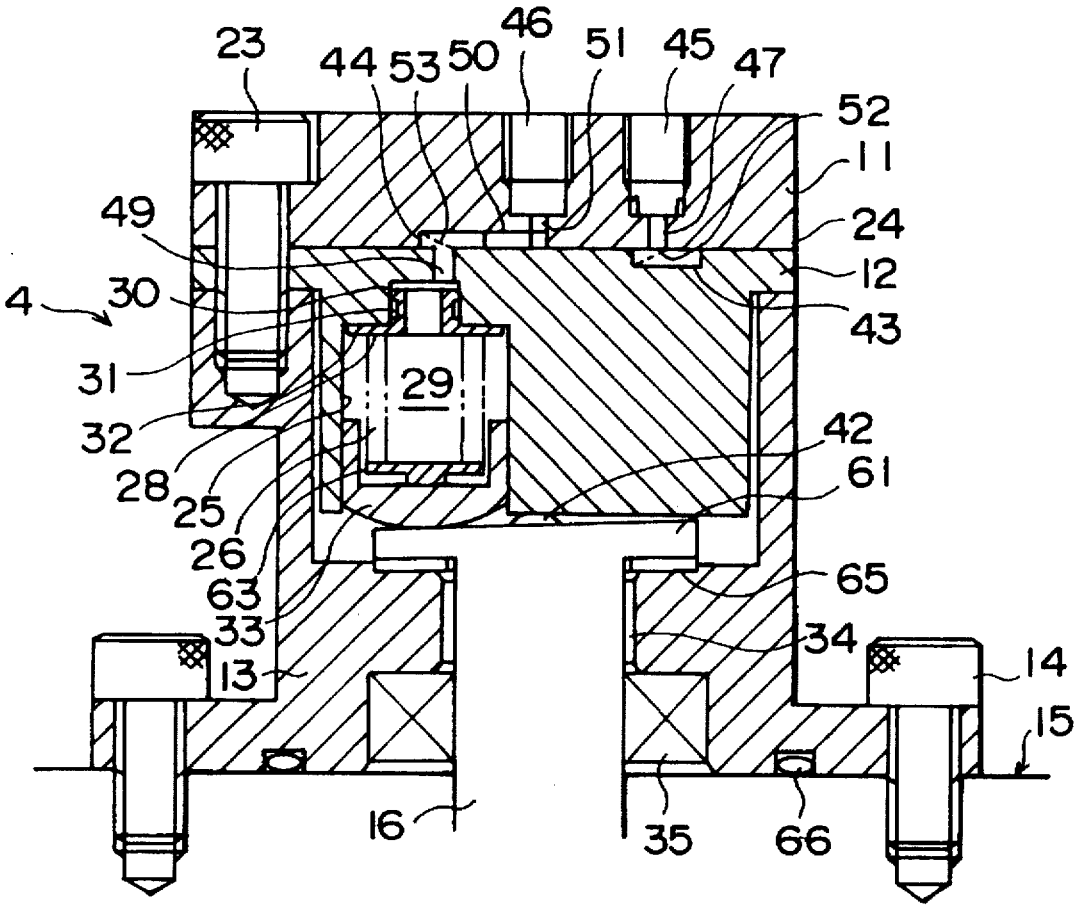
FIG. 10 is a vertical sectional view of a fuel injection pump according to a third embodiment of this invention.

FIG. 10 shows a third embodiment of this invention.

According to this embodiment, the piston 33 is driven by the cam plate 61 as in the second embodiment, however an end plate 63 having a projection in its center is fixed to the bellows 26 instead of the end plate 62. The projection on this end plate 63 comes in contact with the piston 33. This reduces the contact surface area of the end plate 63 with the piston 33 to the extent that a large rotational torque Is not transmitted, however as the contact between the end plate 63 and piston 33 is a surface contact, pressure on the contact parts is reduced.

According to the second and third embodiments which do not use a thrust bearing, the length of the pump in an axial direction can be made shorter than in the first embodiment which does use a thrust bearing.

The embodiments of this invention in which an exclusive property or privilege is claimed are defined as follows:

1. A bellows cam plate pump comprising an input shaft, a pressurizing chamber formed by a bellows that elongates and contracts along a center axis parallel to said input shaft, a cam plate fixed at an inclination to said input shaft, an inlet port for supplying fluid to said pressurizing chamber according to an expansion of said chamber, an outlet port for discharging fluid from said pressurizing chamber according to a contraction of said chamber, a piston for compressing said bellows by a displacement according to a rotation of said cam plate, said piston including a depression for accommodating one end of said bellows, and a cylindrical means displaced substantially coaxial with said bellows for guiding the displacement of said bellows along the center axis of said bellows.

2. A bellows cam plate pump as defined in claim 1, further comprising an auxiliary plate which is in contact with the piston, a member which rolls between said auxiliary plate and said cam plate such that said auxiliary plate is free to rotate relative to said cam plate, and means for preventing rotation of the auxiliary plate.

3. A bellows cam plate pump as defined in claim 1, wherein said depression has such dimensions that said depression accommodates the end of said bellows with a clearance.

4. A bellows cam plate pump as defined in claim 3, wherein said depression has a plane at right angles to said center axis, and said bellows comes in contact with said piston in said plane.

5. A bellows cam plate pump as defined in claim 4, wherein the bellows is connected to a member having a spherical surface which comes in contact with said plane.

6. A bellows cam plate pump as defined in claim 4, wherein the bellows is connected to a member having a projection which comes in contact with said plane.

7. A bellows cam plate pump as defined in claim 1, wherein said piston contacts said cam plate.

8. A bellows cam plate pump as defined in claim 7, wherein said cylindrical means guides said piston such that said piston is free to slide along said center axis.

9. A bellows cam plate pump as defined in claim 8, wherein said depression has a plane at right angles to said center axis, and said bellows is connected to a member having a spherical surface which comes in contact with said plane.

10. A bellows cam plate pump as defined in claim 8, wherein said depression has a plane at right angles to said center axis, and said bellows is connected to a member having a projection which comes in contact with said plane.

11. A bellows cam plate pump as defined in claim 8, wherein said depression is formed with such dimensions that said depression accommodates one end of said bellows with a clearance.

12. A bellows cam plate pump as defined in claim 1, wherein the piston has a spherical surface which comes in contact with the cam plate.

* * * * *